US012178371B2

(12) United States Patent
Valiente-Perez et al.

(10) Patent No.: US 12,178,371 B2
(45) Date of Patent: Dec. 31, 2024

(54) BODY SCRUBBING ASSEMBLY

(71) Applicants: Longino Valiente-Perez, Henderson, NV (US); Maria De Los Angeles Arango-Arrojo, Henderson, NV (US)

(72) Inventors: Longino Valiente-Perez, Henderson, NV (US); Maria De Los Angeles Arango-Arrojo, Henderson, NV (US)

( * ) Notice: Subject to any disclaimer, the term of this patent is extended or adjusted under 35 U.S.C. 154(b) by 308 days.

(21) Appl. No.: 17/853,848

(22) Filed: Jun. 29, 2022

(65) Prior Publication Data

US 2024/0000272 A1 Jan. 4, 2024

(51) Int. Cl.

| | |
|---|---|
| ***A47K 7/02*** | (2006.01) |
| ***A46B 5/00*** | (2006.01) |
| ***A46B 15/00*** | (2006.01) |

(52) U.S. Cl.

CPC ..... *A47K 7/024* (2013.01); *A46B 5/002* (2013.01); *A46B 5/0095* (2013.01); *A46B 15/0097* (2013.01); *A46B 2200/1006* (2013.01)

(58) Field of Classification Search

CPC ..... A46B 2200/1006; A47K 7/024

See application file for complete search history.

(56) References Cited

U.S. PATENT DOCUMENTS

| | | | | |
|---|---|---|---|---|
| 4,696,068 | A * | 9/1987 | Kenner | A47K 7/024 15/210.1 |
| 5,345,640 | A * | 9/1994 | Goss | A47K 7/04 4/606 |
| 6,732,394 | B1 | 5/2004 | Waterman | |
| 8,272,799 | B1 | 9/2012 | Yard | |
| 2006/0107473 | A1 | 5/2006 | Torres | |
| 2009/0241257 | A1 | 10/2009 | Malta | |

FOREIGN PATENT DOCUMENTS

| | | |
|---|---|---|
| WO | WO2016071839 | 5/2016 |

* cited by examiner

*Primary Examiner* — Andrew A Horton

(57) ABSTRACT

A body scrubbing assembly for facilitating a user to wash their back without assistance includes a dome that is comprised of a deformable material thereby facilitating the dome to be compressed against a wall of a shower such that the dome suctionally engages the wall. A fastener is integrated into the dome. A base is provided and a fastening element is integrated into the base. The fastening element releasably engages the fastener for attaching the base to the dome. A plurality of bristles is each coupled to and extends away from the base to facilitate a user to scrub their back against the bristles when the user is taking a shower.

4 Claims, 5 Drawing Sheets

BODY SCRUBBING ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to scrubbing devices and more particularly pertains to a new scrubbing device for facilitating a user to wash their back while showering. The device includes a suction cup that suctionally engages a wall of a shower and a fastener that is attached to the section cup. The device includes a base that engages the fastener and a plurality of bristles disposed on the base. The bristles facilitate a user to scrub their back on the bristles while the user is showering.

(2) Description of Related Art Including Information Disclosed Under 37 CFR 1.97 and 1.98

The prior art relates to back scrubber devices including an automatic back scrubber that includes a soap reservoir for scrubbing the dorsal portion of a user in a shower. The prior art discloses a back scrubber that includes a single scrubbing brush and a single suction cup for scrubbing a user's back in a shower. The prior art also discloses an automatic back scrubber than has a polygonal shape. Additionally, the prior art discloses an automatic back scrubber that includes a plurality of scrubbing brushes being arranged in a plurality of columns and rows.

BRIEF SUMMARY OF THE INVENTION

An embodiment of the disclosure meets the needs presented above by generally comprising a dome that is comprised of a deformable material thereby facilitating the dome to be compressed against a wall of a shower such that the dome suctionally engages the wall. A fastener is integrated into the dome. A base is provided and a fastening element is integrated into the base. The fastening element releasably engages the fastener for attaching the base to the dome. A plurality of bristles is each coupled to and extends away from the base to facilitate a user to scrub their back against the bristles when the user is taking a shower.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
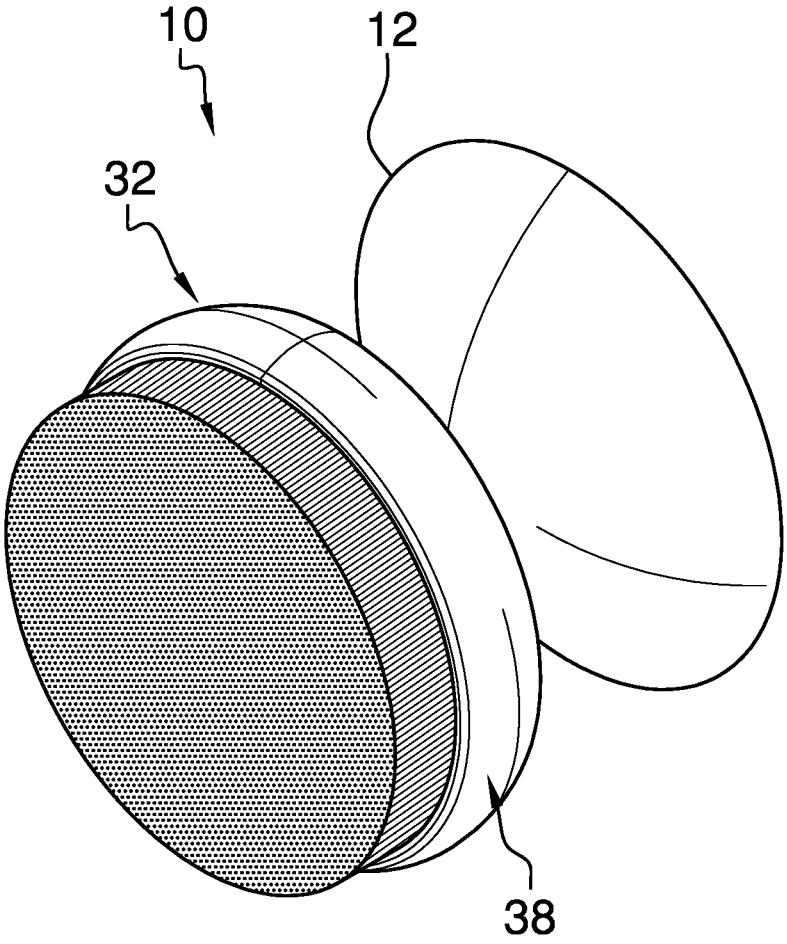
FIG. 1 is a perspective view of a body scrubbing assembly according to an embodiment of the disclosure.
Figure 2:
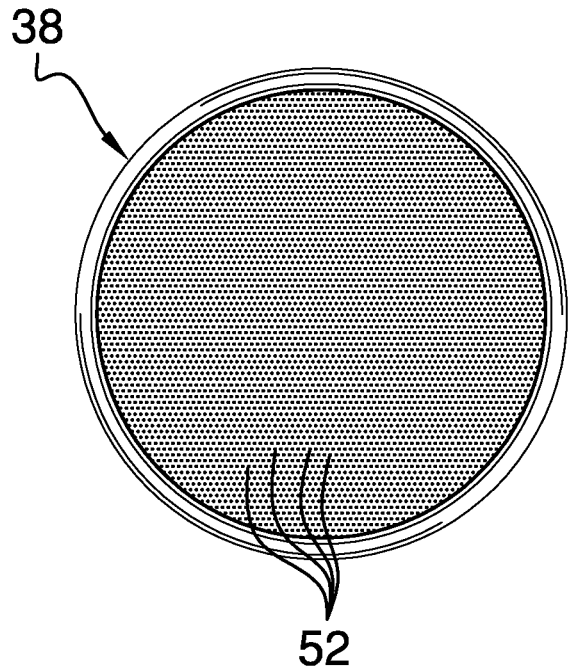
FIG. 2 is a front view of an embodiment of the disclosure.
Figure 3:
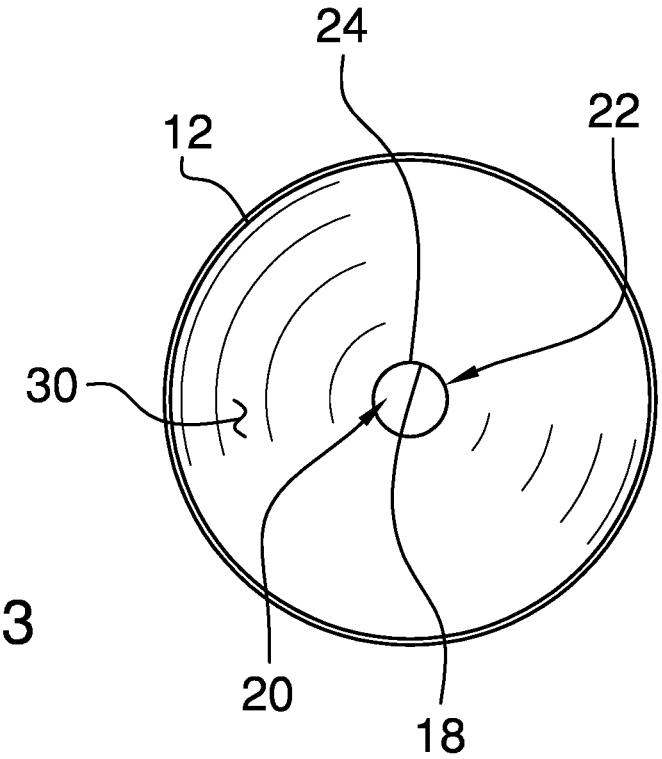
FIG. 3 is a back view of an embodiment of the disclosure.
Figure 4:
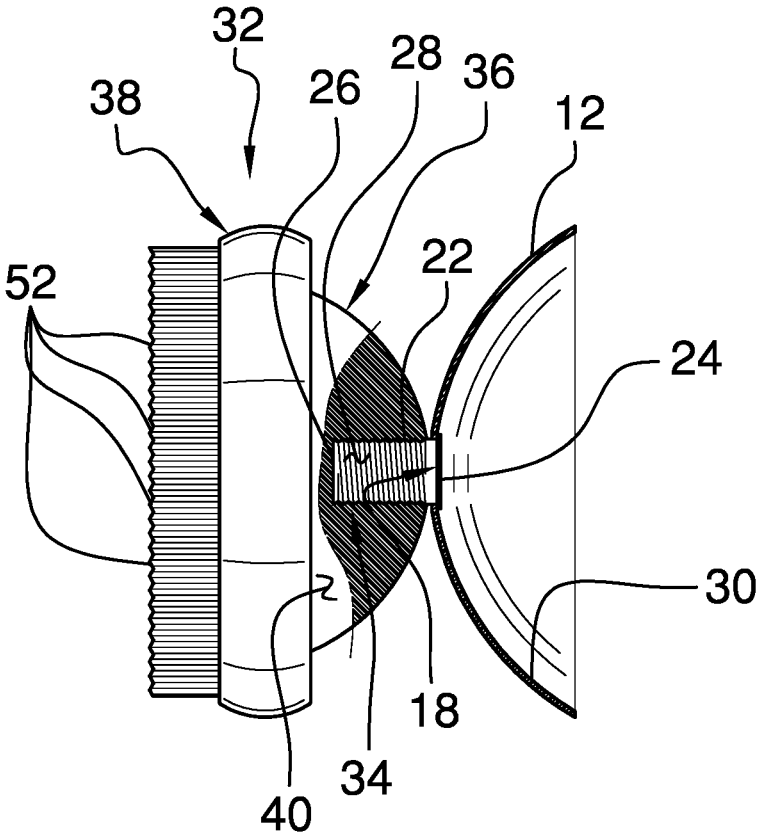
FIG. 4 is a left side cut-away view of an embodiment of the disclosure.
Figure 5:
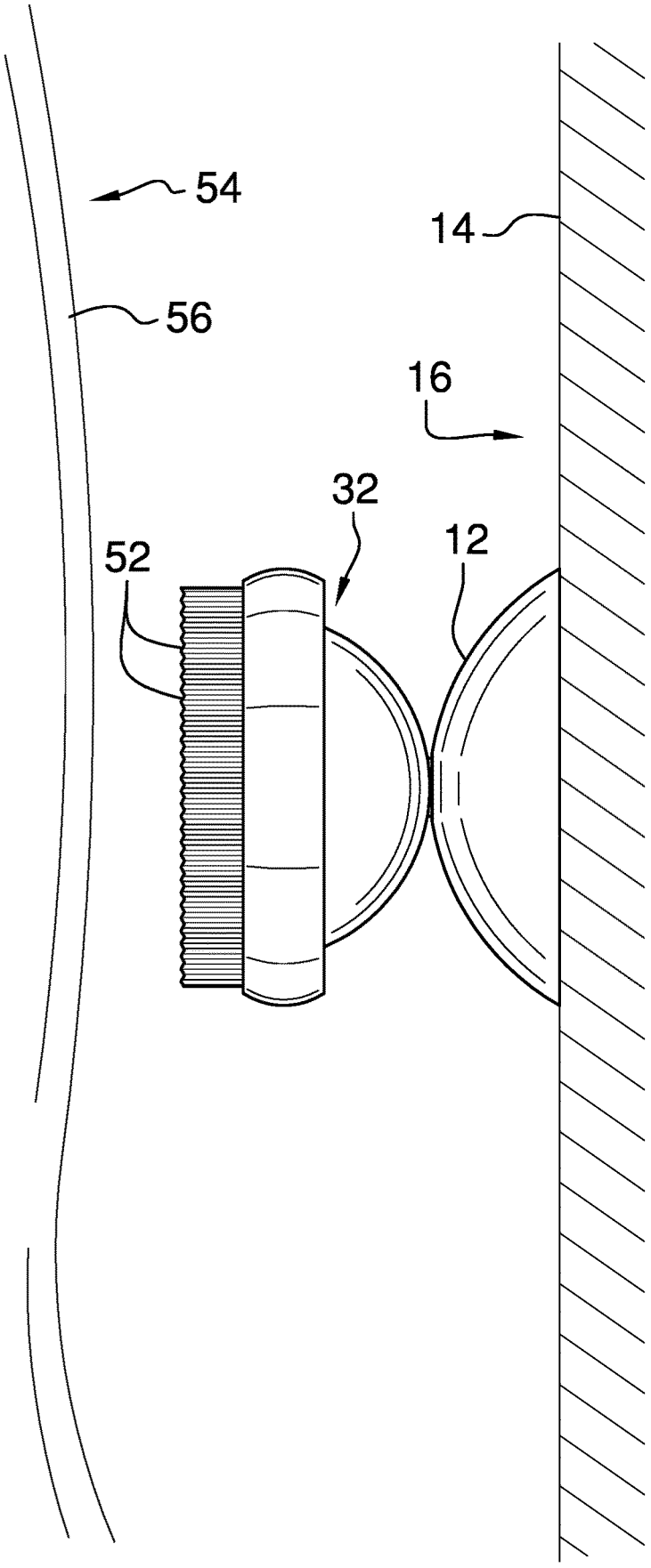
FIG. 5 is a perspective in-use view of an embodiment of the disclosure.
Figure 6:
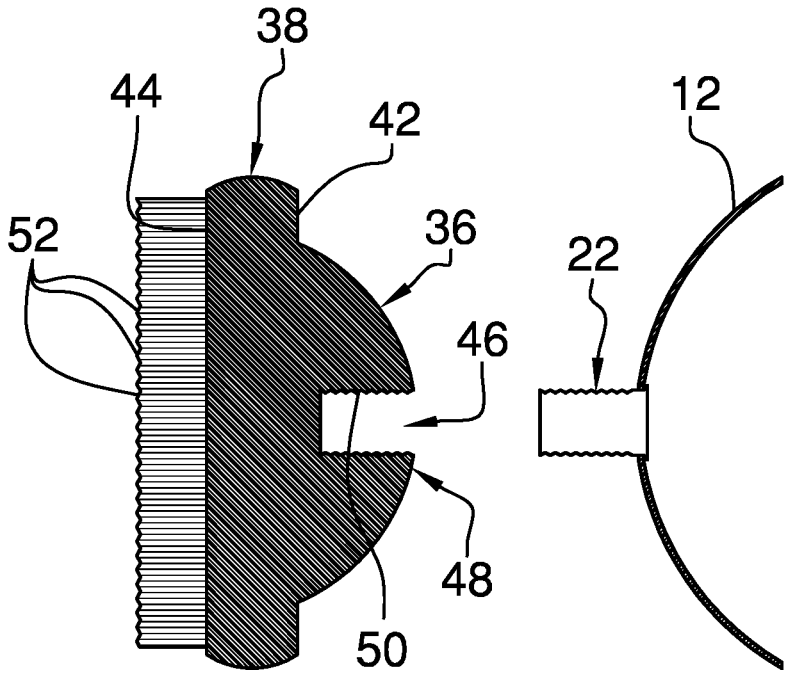
FIG. 6 is an exploded perspective view of an embodiment of the disclosure.

With reference now to the drawings, and in particular to FIGS. 1 through 6 thereof, a new scrubbing device embodying the principles and concepts of an embodiment of the disclosure and generally designated by the reference numeral 10 will be described.

As best illustrated in FIGS. 1 through 6, the body scrubbing assembly 10 generally comprises a dome 12 that is comprised of a deformable material thereby facilitating the dome 12 to be compressed against a wall 14 of a shower 16 such that the dome 12 suctionally engages the wall 14. The shower 16 may be a bathing shower of any conventional design, including but not being limited to, a walk in shower or a tub/shower combo. The dome 12 has a hole 18 extending through an apex 20 of the dome 12. A fastener 22 is integrated into the dome 12 and the fastener 22 has a head 24 and a shaft 26 extending away from the head 24. The shaft 26 has an outer surface 28, the outer surface 28 is threaded and the shaft 26 extends through the hole 18 in the apex of the dome 12. The head 24 abuts a back surface 30 of the dome 12 thereby inhibiting the fastener 22 from passing through the hole 18.

A base 32 is provided, a fastening element 34 is integrated into the base 32 and the fastening element 34 releasably engages the fastener 22 for attaching the base 32 to the dome 12. The base 32 has a convex portion 36 and a planar portion 38, the convex portion 36 has an outside surface 40 and the planar portion 38 has a rear side 42 and a front side 44. The outside surface 40 is convexly arcuate with respect to the rear side 42 and the outside surface 40 has a well 46 extending toward the rear side 42 of the planar portion 38 such that the well 46 defines the fastening element 34. The well 46 is aligned with an apex 48 of the convex portion 36, the well 46 has a bounding surface 50 and the bounding surface 50 is threaded. Furthermore, the well 46 insertably receives the shaft 26 of the fastener 22 having the outer surface 28 of the shaft 26 threadably engaging the bounding surface 50 of the well 46. The base 32 is comprised of a fluid impermeable material, such as plastic or the like, such that the base 32 does not absorb water from the shower 16. The planar portion 38 may have a diameter that is greater than a maximum diameter of the convex portion 36.

A plurality of bristles 52 is provided and each of the bristles 52 is coupled to and extends away from the base 32. In this way the bristles 52 facilitate a user 54 to scrub their back 56 against the bristles 52 when the user 54 is taking a shower 16. Each of the bristles 52 is positioned on the front side 44 of the planar portion 38 of the base 32 and the bristles 52 are distributed over a majority of the front side 44. Additionally, each of the bristles 52 is comprised of a resiliently bendable material thereby enhancing comfort for the user 54.

In use, the dome 12 is compressed against the wall 14 of the shower 16 at a height that is sufficient to align the dome 12 with a desired location on the user's back 56. The base 32 is threaded onto the fastener 22 thereby facilitating the base 32 to be mounted to the wall 14 of the shower 16. In this way the bristles 52 are oriented to facilitate the user 54 to scrub their back 56 against the bristles 52 when the user 54 is taking a shower 16. Thus, the user 54 can wash their back 56 without assistance with the user 54 is taking a shower 16. The base 32 can be removed from the fastener 22 to facilitate the bristles 52 to be rinsed or otherwise serviced without removing the dome 12 from the wall 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A body scrubbing assembly comprising:

a dome being comprised of a deformable material thereby facilitating said dome to be compressed against a wall of a shower such that said dome suctionally engages the wall;

a fastener being integrated into said dome;

a base having a fastening element being integrated into said base, said fastening element releasably engaging said fastener for attaching said base to said dome; and a plurality of bristles, each of said bristles being coupled to and extending away from said base wherein each of said bristles is configured to facilitate a user to scrub their back against said bristles when the user is taking a shower;

wherein said base has a convex portion and a planar portion, said convex portion having an outside surface, said planar portion having a planar rear side and a planar front side, said outside surface of said convex portion being convexly arcuate with respect to said rear side, said outside surface having a well extending toward said rear side of said planar portion such that said well defines said fastening element, said convex portion being centered on said rear side of said planar portion; and wherein said well is aligned with an apex of said convex portion such that said well is centered relative to said plurality of bristles, said well having a bounding surface, said bounding surface being threaded, said well insertably receiving said shaft of said fastener having said outer surface of said shaft threadably engaging said bounding surface of said well.

2. The assembly according to claim 1, wherein:

said dome has a hole extending through an apex of said dome; and said fastener has a head and a shaft extending away from said head, said shaft having an outer surface, said outer surface being threaded, said shaft extending through said hole in said apex of said dome having said head abutting a back surface of said dome thereby inhibiting said fastener from passing through said hole.

3. The assembly according to claim 1, wherein each of said bristles is positioned on said front side of said planar portion of said base, said bristles being distributed over a majority of said front side, each of said bristles being comprised of a resiliently bendable material thereby enhancing comfort for the user.

4. A body scrubbing assembly comprising:

a dome being comprised of a deformable material thereby facilitating said dome to be compressed against a wall of a shower such that said dome suctionally engages the wall, said dome having a hole extending through an apex of said dome;

a fastener being integrated into said dome, said fastener having a head and a shaft extending away from said head, said shaft having an outer surface, said outer surface being threaded, said shaft extending through said hole in said apex of said dome having said head abutting a back surface of said dome thereby inhibiting said fastener from passing through said hole;

a base having a fastening element being integrated into said base, said fastening element releasably engaging said fastener for attaching said base to said dome, said base having a convex portion and a planar portion, said convex portion having an outside surface, said planar portion having a planar rear side and a planar front side, said outside surface of said convex portion being convexly arcuate with respect to said rear side, said outside surface having a well extending toward said rear side of said planar portion such that said well defines said fastening element, said well having a bounding surface, said bounding surface being threaded, said well insertably receiving said shaft of said fastener having said outer surface of said shaft threadably engaging said bounding surface of said well;

a plurality of bristles, each of said bristles being coupled to and extending away from said base wherein each of said bristles is configured to facilitate a user to scrub their back against said bristles when the user is taking a shower, each of said bristles being positioned on said front side of said planar portion of said base, said bristles being distributed over a majority of said front side, each of said bristles being comprised of a resiliently bendable material thereby enhancing comfort for the user; and wherein said well is aligned with an apex of said convex portion such that said well is centered relative to said plurality of bristles.

* * * * *